US005462399A

United States Patent [19]

Clupper et al.

[11] Patent Number: 5,462,399

[45] Date of Patent: Oct. 31, 1995

[54] VERTICAL TRAY COLLATOR WITH SHEET DISCHARGE PUSHER MEMBER

[76] Inventors: Charles B. Clupper, 1120 Oak Tree Cir., El Dorado Hills, Calif. 95762; Jonathan D. Emigh, 7050 Aukum Rd., Somerset, Calif. 95684; Steven L. Mulkey, 2687 Hillcrest Dr., Cameron Park, Calif. 95682; Robert L. Fehringer, 3395 Rio Vista, Camino, Calif. 95709; Brett J. Flickner, 259 Wellfleet Cir., Folsom, Calif. 95630; Daniel M. Saldana, 11082 Erla Ct., Rancho Cordova, Calif. 95670; Frank W. Delfer, III, 7460 Shelborne Dr., Loomis, Calif. 95650

[21] Appl. No.: 276,092

[22] Filed: Jul. 15, 1994

[51] Int. Cl.[6] ..... B65G 57/00; B65H 31/30; B65H 39/05

[52] U.S. Cl. ..... 414/790.3; 414/789.6; 270/58

[58] Field of Search ..... 270/53, 58, 59; 414/789.6, 789.8, 791, 791.1; 198/448

[56] References Cited

U.S. PATENT DOCUMENTS

| | | | |
|---|---|---|---|
| 3,550,493 | 12/1970 | Benbenek et al. | 414/791.1 X |
| 4,733,856 | 3/1988 | Gunter, Jr. | 270/58 X |
| 4,800,505 | 1/1989 | Axelrod et al. | 270/58 X |
| 5,285,249 | 2/1994 | Mahoney | 270/53 X |

FOREIGN PATENT DOCUMENTS

| | | | |
|---|---|---|---|
| 1538066 | 1/1979 | United Kingdom | 270/58 |

*Primary Examiner*—John E. Ryznic
*Attorney, Agent, or Firm*—James M. Ritchey

[57] ABSTRACT

A collating system for producing a plurality of document packets with each document packet having at least one page has a database containing requisite information for forming each of the document packets and a computer controller for accessing the database for the requisite information to produce each of the document packets. A multi-tray collator creates each of the document packets as directed by the computer. A plurality of inputting mechanisms feeds pages into the trays of the collator and an outputting mechanism transfers each of the document packets created by the collator to a subsequent processor.

30 Claims, 10 Drawing Sheets

VERTICAL TRAY COLLATOR WITH SHEET DISCHARGE PUSHER MEMBER

BACKGROUND OF THE INVENTION

1. Field of the Invention

Related is a system for collating a plurality of incoming document sheet or page streams into a unified packet. More specifically, disclosed are a collating apparatus and control system for merging and stacking document sheet or page streams that converge in a central tray from a plurality of input directions and levels. The collated document packet is then ejected to further processing equipment.

2. Description of the Background Art

For a competitive and profitable billing operation to survive and grow, when periodic statements are printed for customers of services or goods, efficiency is of the essence. Often a statement comprises a plurality of pages that need to be printed and assembled into a suitable mailing piece. The assembly process or collation is usually time consuming and, if different information is to be printed on various pages, difficult to coordinate.

Various collating mechanisms exist, however, no multi-directional/multi-level collating apparatus is known. Generally, a collating apparatus functions to receive a plurality of incoming sheets from one source and positions those incoming sheets into one or more piles, each pile with multiple pages. The subject invention dramatically varies the prior schemes by accepting sheets of pages from a plurality of different directional and elevational incoming sources and pooling the incoming sheets or pages into a single pile or packet for subsequent processing.

SUMMARY OF THE INVENTION

An object of the present invention is to disclose a collating apparatus that accepts incoming document sheet or page streams from a plurality of directions and levels and collates the sheets or pages into a packet for subsequent processing.

Another object of the present invention is to relate a collating apparatus that is controlled by a database directed computer system that collates multiple page packets in which pages enter the packet from more than one direction.

A further object of the present invention is to describe a collating apparatus that is controlled by a database directed computer system which collates multiple page packets in which pages enter the packet from more than one direction and more than one level.

Still another object of the present invention is to provide a collating system incorporating a database controlled apparatus that collates a plurality of incoming streams of document sheets or pages into a packet for subsequent processing.

Yet a further object of the present invention is to furnish a collating system incorporating a database controlled apparatus which collates a plurality of directionally and elevationally displaced incoming streams of document sheets or pages into a packet for subsequent processing.

Disclosed is a collating apparatus for producing a document packet from an incoming document page or pages. Specifically for an apparatus that receives pages from two sources, a collating means for producing the document packet comprises a first collating tray for receiving at least a first document page and a second collating tray secured to the first collating tray and having two opposing side walls and a bottom plate for receiving any second document page or pages. Further, provided is an outputting means for transferring the document packet created by the collating means to a subsequent processing means. The outputting means comprises means for concurrently ejecting all document pages from the collating means to produce the document packet and means for receiving from the ejecting means and transferring to the subsequent processing means the document packet.

Additionally, first inputting means is included for feeding a first document page from a first incoming source into the collating means. The first imputing means comprises a first source containing the first document page for each document packet to be produced and means for transferring the first document page into the collating means.

Further, a second inputting means is supplied for feeding a second document page from a second incoming source into the collating means. The second imputing means comprises a second source containing the second document page for each document packet to be produced and means for transferring the second document page into the collating means. Usually, the second inputting means is displaced approximately 90° from the first inputting means. Likewise, additional inputting means are provided if more than two incoming sources are present and oriented at approximately 90° to one another or in elevationally displaced positions to one another.

Preferably, the collating means further comprises a first detection means for establishing whether delivery of the first document page into the collating means has been performed. Also, the collating means further comprises a second detection means for establishing whether delivery of the second document page into the collating means has been performed. Additionally, the collating means further comprises a third detection means for establishing whether the collating means contains the first or the second document pages. Further, the collating means further comprises a fourth detection means for establishing whether the document packet has exited the collating means to a subsequent processing means.

Other objects, advantages, and novel features of the present invention will become apparent from the detailed description that follows, when considered in conjunction with the associated drawings.

DESCRIPTION OF THE PREFERRED EMBODIMENT

Figure 1:
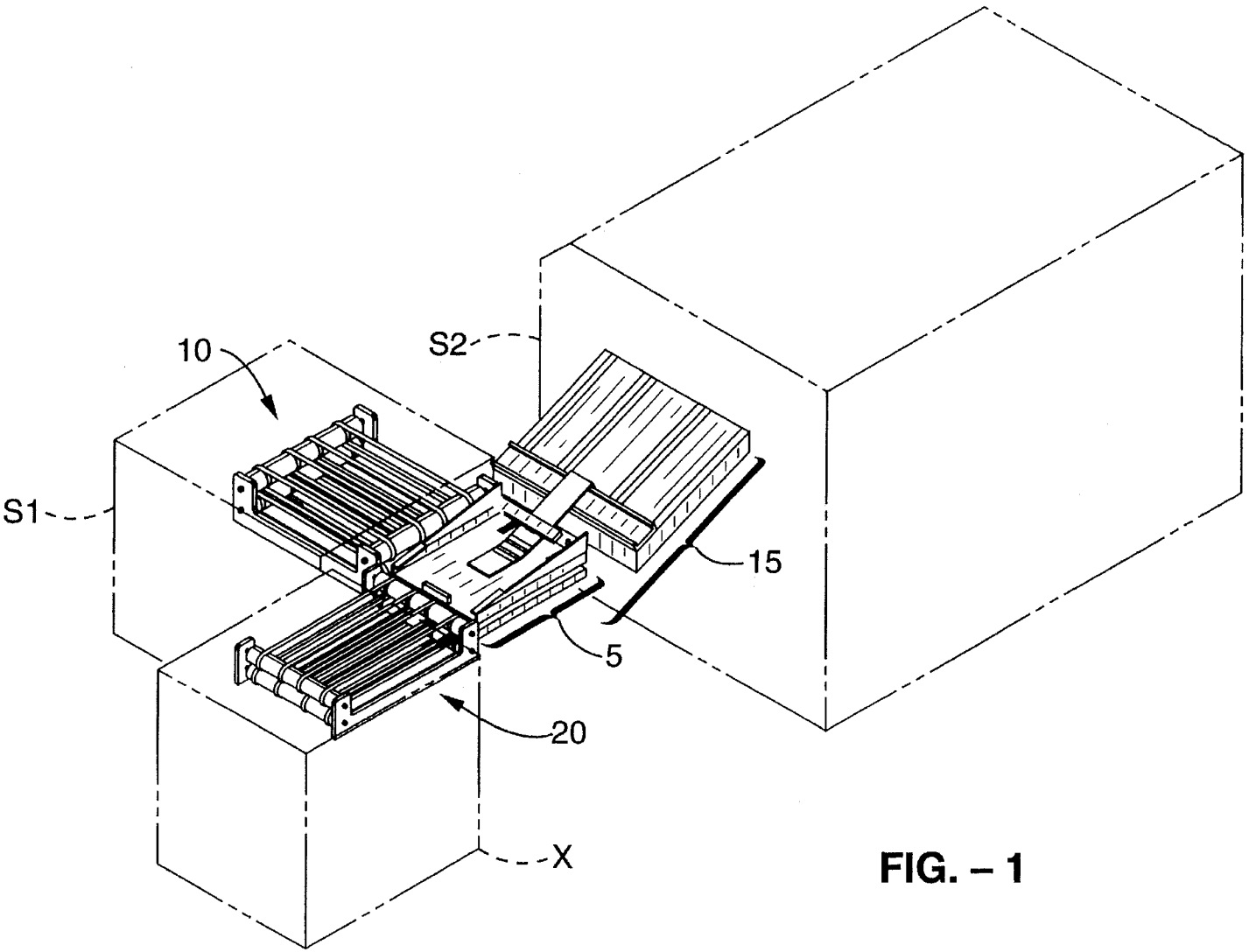
FIG. 1 is a perspective view of the subject invention.

For illustrative purposes only, the subject invention will be described in terms of utilization in a billing operation in which customers have received services or products over a past period of time and are regularly billed for those services. A billing process periodically generates billing statements from a database containing relevant information about the customers and the services or goods providers. The billing statements or document packets typically contain at least a summary page that usually has a billing summary printed only on one side of the page, but a double sided summary page is contemplated by this disclosure. Printing of a one-sided summary page is often performed by a simplex-type printer either at the location of the subject collator or at a location distant to the subject collator and then moved to the subject collator.

Generally, included in each billing statement or document packet is an additional page or pages, usually printed on both sides of each page, that provide the details of the transactions for the goods or services. Printing of these detail pages is usually by a duplex-type printer that is often located at the site of the subject collator, but a distant location for the duplex-type printer is also considered possible.

Since a summary sheet and the included detail page or pages must be assembled into a mailing piece or document packet within one envelope, a logistics problem exists that is overcome by the subject invention. A document packet may contain only one document page, however, usually, a first stream of summary pages is merged into the document packet with at least a second stream of detail pages by the collator of the subject invention (it is noted that, depending upon the requirements of a particular document packet creation situation, the first stream may contain the detail pages and the second stream contain the summary pages). Usually, at least two different printers (and even more than two, as seen below) are utilized to print the summary sheet and the detail pages, and as noted, the merging of the two separate streams of pages could cause a logjam to exist if the two types of sheet streams are not collated quickly and reliably merged into a single mailable document packet. The subject invention serves to collate rapidly and efficiently the incoming pages into the mailable document packet.

For a general synopsis of the subject invention, the subject collating apparatus for producing a document packet from an incoming document page or pages comprises a collating means having a plurality of collating trays, preferably displaced from one another in a generally vertical orientation. Each of the collating trays accepts a single document page or multiple document pages. Outputting means are included and coupled to the collating means for transferring the incoming page or pages from the collating means as the document packet to a subsequent processing means. Further, as a preferred portion of the subject invention, multi-directional inputting means are embraced for transferring into the collating means a plurality of streams of incoming document pages from at least two directions. Also comprising the subject invention are detection means for establishing whether the document page or pages have been delivered into the collating means, whether the collating means contains the document page or pages, and whether the document packet has exited the collating means.

Referring now to FIGS. 1–10, there is shown a preferred embodiment of a collating system comprising inputting means, a collating tray mechanism, outputting means, and typical control instruction shown in flow diagram form. For exemplary purposes only, FIG. 1 illustrates the subject system having two sources or inputting means for supplying to the collating apparatus incoming documents. A first source S1 for a first stream of document pages enters the collating means 5 via a transferring means 10. The first source S1 supplies either a single document page or a plurality of document pages for each assembled document packet, usually a single summary page, printed on one side, when the subject apparatus is assembling a billing statement. The first transferring means 10 for conveying the first document pages into the collating means 5 is shown in FIG. 1 to be belts that frictionally feed each desired document page or sheet into the collating means 5, but other equivalent means (i.e. cable drives, air drives, standard combinations, and the like) are considered to be within the realm of this disclosure.

A second source S2 for a second stream of document pages enters the collating means 5 via a transferring means 15. Usually, the second source S2 supplies either a single document page or a plurality of document pages for each assembled document packet, usually a detailed billing page or pages, printed on both sides, if necessary, when the subject apparatus is assembling the exemplary billing statement employed herein. The second transferring means 15 for conveying the second document pages into the collating means 5 is shown in FIG. 1 to be a belt system coupled to a deflector arm having page directing air jets (and other equivalent means are within the purview of this disclosure). The components of the second transferring means 15 will be described in detail below in reference to FIG. 5.

Included in the subject invention is an outputting means. Partially comprising, along with the concurrent ejection means described below, the outputting means is commonly a belt system 20, usually cooperatively paired with upper and lower belts, for transferring the produced document packet from the subject collator 5 to a subsequent processing means X, such as a folder or the like (as just indicated, an additional preferred portion of the outputting means, discussed in detail below, is an element for concurrently ejecting into the exiting-transfer system 20 all of the document pages from the collating means to produce the document packet). Specifically, shown in FIG. 1 are cooperating belts 20 that frictionally grasp the produced document packet. Other acceptable means equivalent to the paired belts 20, such as single belts, cable drives, air or vacuum drives, and the like, are viewed as being within this disclosure.

Figure 2:
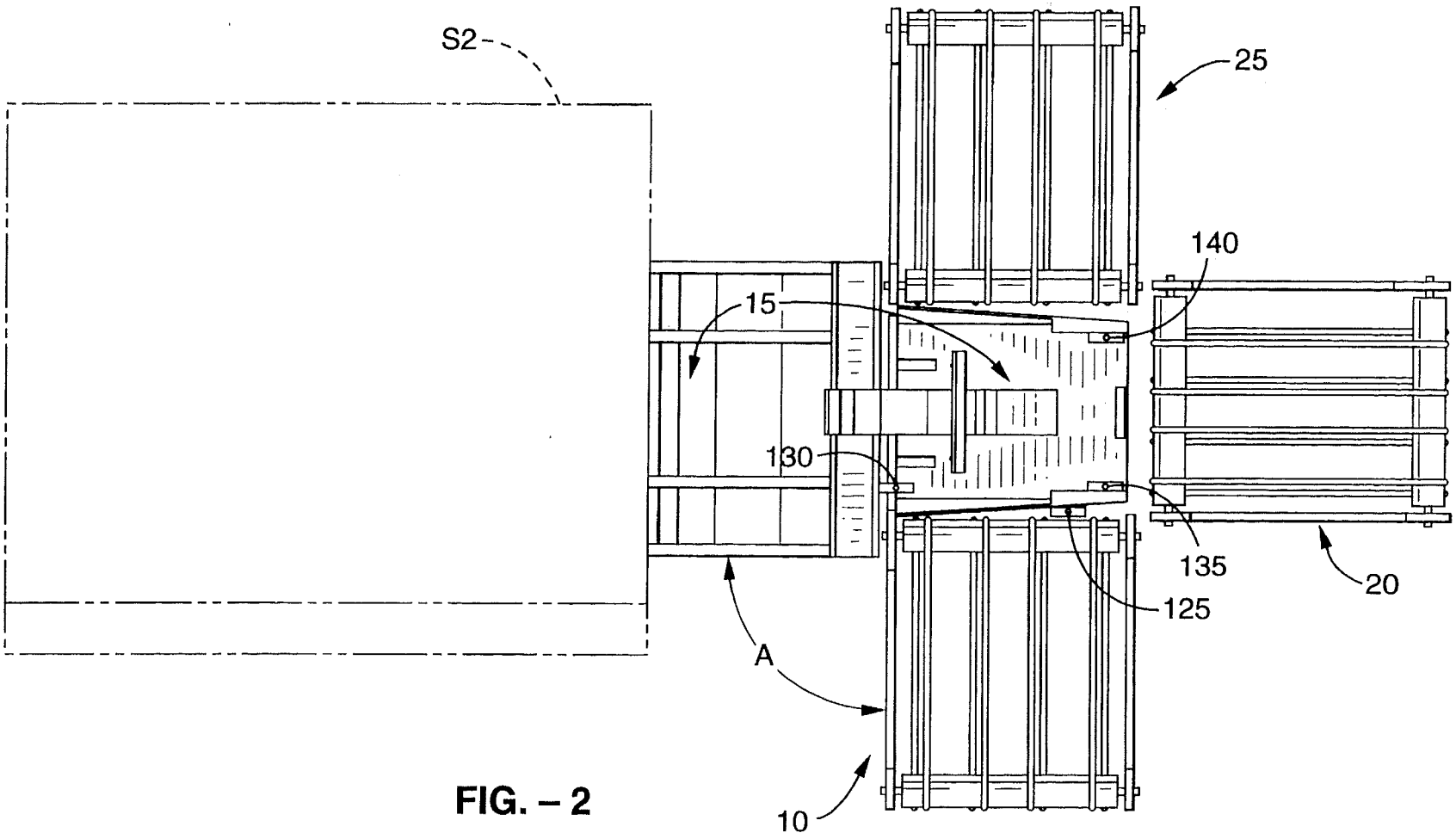
FIG. 2 is a top view of the subject invention.

As seen in particular in FIGS. 1 and 2, the subject apparatus has multi-directional inputting means (first and second inputting means 10 and 15 in FIG. 1 and an additional third inputting means 25 in FIG. 2) for transferring into the collating means a plurality of streams of incoming document pages from directions that are usually separated by approximately 90° from one another, indicated by the letter A in FIG. 2. Although 90° is preferred, other angles suitable for transferring incoming document streams into the subject collating means are acceptable.

Additional inputting means can be incorporated into the subject invention by stacking or off-setting further inputting means beneath, above, or beyond the shown inputting means or by equivalent structural orientations and configurations. Tiered, stacked, or elevationally or vertically displaced inputting means may be utilized to feed additional streams of document pages into a suitably modified collation means

5.

Figure 3:
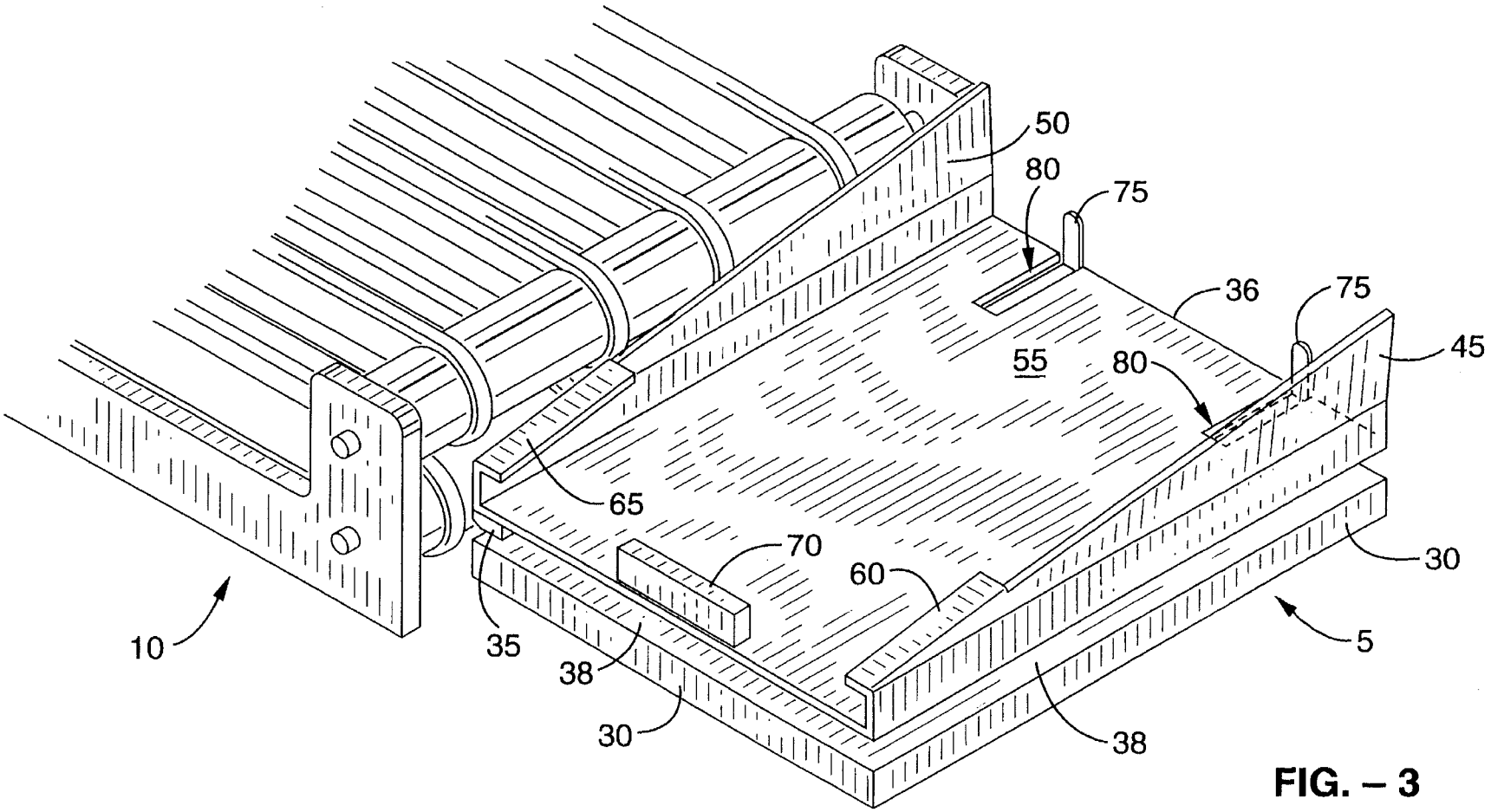
FIG. 3 is a perspective view of the subject collating tray and associated first inputting means.
Figure 4:
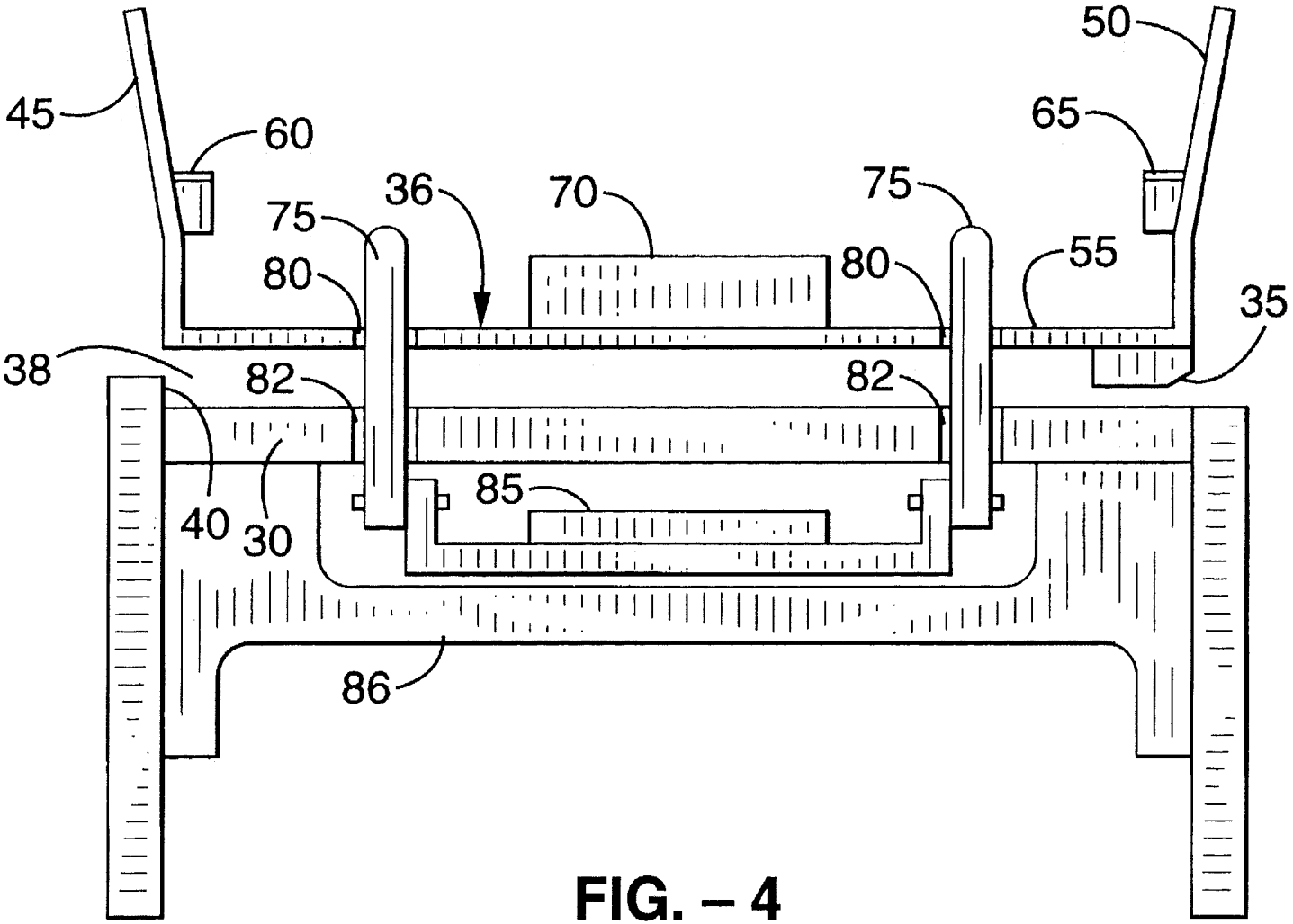
FIG. 4 is an end view of the subject collating means.

A preferred embodiment of the subject collating means 5 is depicted in detail in FIGS. 3 and 4. Comprising the collating means is a plurality of vertically or elevationally displaced collating trays. A first collator tray 30 is configured below a second collator tray 36. Incoming pages from the first source 10 enter into the first collator tray 30 by means of a flared page feeder bar 35 (see FIG. 4) cooperating with the surface of the first collator tray 30. The inputted pages from the first inputting means 10 encounter the edge of the first collator tray 30 and the tapered leading edge of the feeder bar 35 and are funneled into a space 38 above the first collator tray 30 and below the second collator tray 36. A page barrier 40 stops the incoming page's motion within the first collating tray 30. It is noted that additional collating trays beneath or above the first collating tray 30 and similar to the first collating tray 30 may be incorporated into the subject device for accepting incoming document source streams from other directions (such as the third inputting means 25) and multiple layers of inputting means.

The second collating tray 36 is the top most tray (also, the top most tray in equivalent elevationally displaced systems with more than two trays) and has two opposing side walls 45 and 50 and a bottom plate 55. Often, page guards 60 and 65 are formed into one end of the second tray 36, extending from the side walls (45 and 50, respectively) and above the bottom plate 55. Document pages that enter the second collator tray 36 from the second inputting means 15 have their forward motion stopped by a retractable or movable gate 70. At determined times (preferably determined by an associated computer accessing appropriate billing information, as discussed below), the gate 70 is opened for the document packet to exit the collating means 5. Preferably, the gate 70 is activated to open and close by means such as an air, vacuum, or electric driven solenoid or comparable means.

As indicated above, the outputting means comprises not only the belts 20, but additional means for concurrently removing all document pages from the collating means 5. Preferably, a timed kicker means is combined into the subject apparatus to concurrently eject all of the document pages from all of the included trays (first tray 30, second tray 36, and any additional trays). Specifically, kicker arms 75 are fitted to the collating trays 30 and 36. Slots (80 in the second upper tray 36 and 82 in the first lower tray 30) are included for receiving the kicker arms 75. Usually, a pair of kicker arms 75 are employed, but a single kicker arm or more than two kicker arms are possible. Kicker arm activating means 85 (mounted in a receiving and supporting frame 86) are coupled to the kicker arms 75. At determined times (when a complete document packet has been fed into the collator means 5) and after the gate 70 has been opened, the kicker activating means 85 functions to engage the kicker arms 75, thereby rapidly kicking the collated pages from the involved trays and into the means for transferring the packet to the subsequent processing means. It should be noted that the gate 70 may function to prevent not only the upper document page or pages from prematurely exiting only the second tray 36, but may function to prevent the pages in a lower tray (including the first tray 30) from accidentally exiting into the outputting means before desired.

The kicker activating means 85 usually comprises an air, vacuum, or electric solenoid driven combination of appropriately interacting components, but other equivalent means are considered as potentially suitable. When the kicker activating means 85 is engaged the kicker arms 75 rapidly retract into the slots (80 and 82), thereby quickly forcing the pages within the trays to rapidly exit into the receiving means or set of belts 20.

Figure 5:
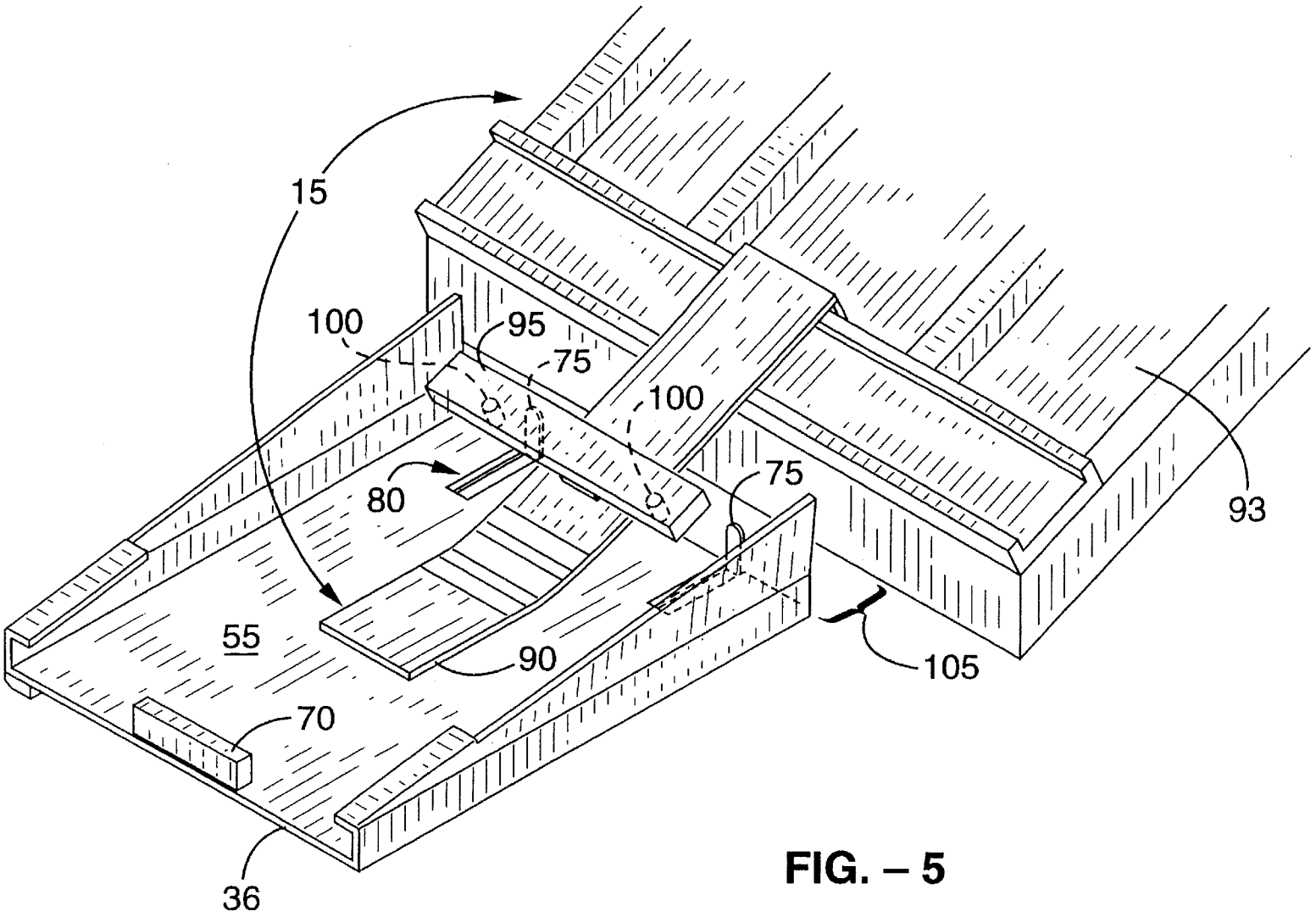
FIG. 5 is a perspective view of the collating means and second inputting means of the subject invention.

FIG. 5 shows the details of a preferred structure for the second inputting means 15. Although other means may be acceptable, the presented version of the second inputting means 15 is capable of rapidly delivering into the second tray 36 a plurality of duplexed pages with a high degree of efficiency. A page settling means (allowing for the settling pages into the receiving tray) is needed for high speed processing and material inconsistencies. Specifically, the page settling means includes a page deflection bar 90 that is attached to a page transfer means 93, which is usually directly attached to the second inputting source (generally, the standard page outputting means, single or paired belts and the like, for a simplex or duplex-type printer is modified to include the deflection bar 90). Secured to the deflection bar 90 is an air nozzle support rack 95 have at least one and preferably two or more air nozzles 100 that assist in settling the incoming pages into the upper tray 36. Incoming sheets or pages pass over the kicker arms 75 and below the deflection bar 90 to enter the second or upper tray 36.

Preferably, a page rejection means is incorporated into the region 105 between the page transfer means 93 and the page deflection bar 90. The page rejection means functions to eliminate from entering the upper tray 36 any non-desired pages. Often a printer will generate waste or extra pages between desired pages for a particular document packet. Such waste pages need to be quickly discarded from inclusion into the document packet. The form of the page rejection means can vary, but a movable arm, lever, or plate that deflects or directs the waste pages downward into a waste receptacle is contemplated. The page rejection means is controlled or activated by an associated computer means (see below) that has information concerning the presence or absence of waste pages.

Figure 6:
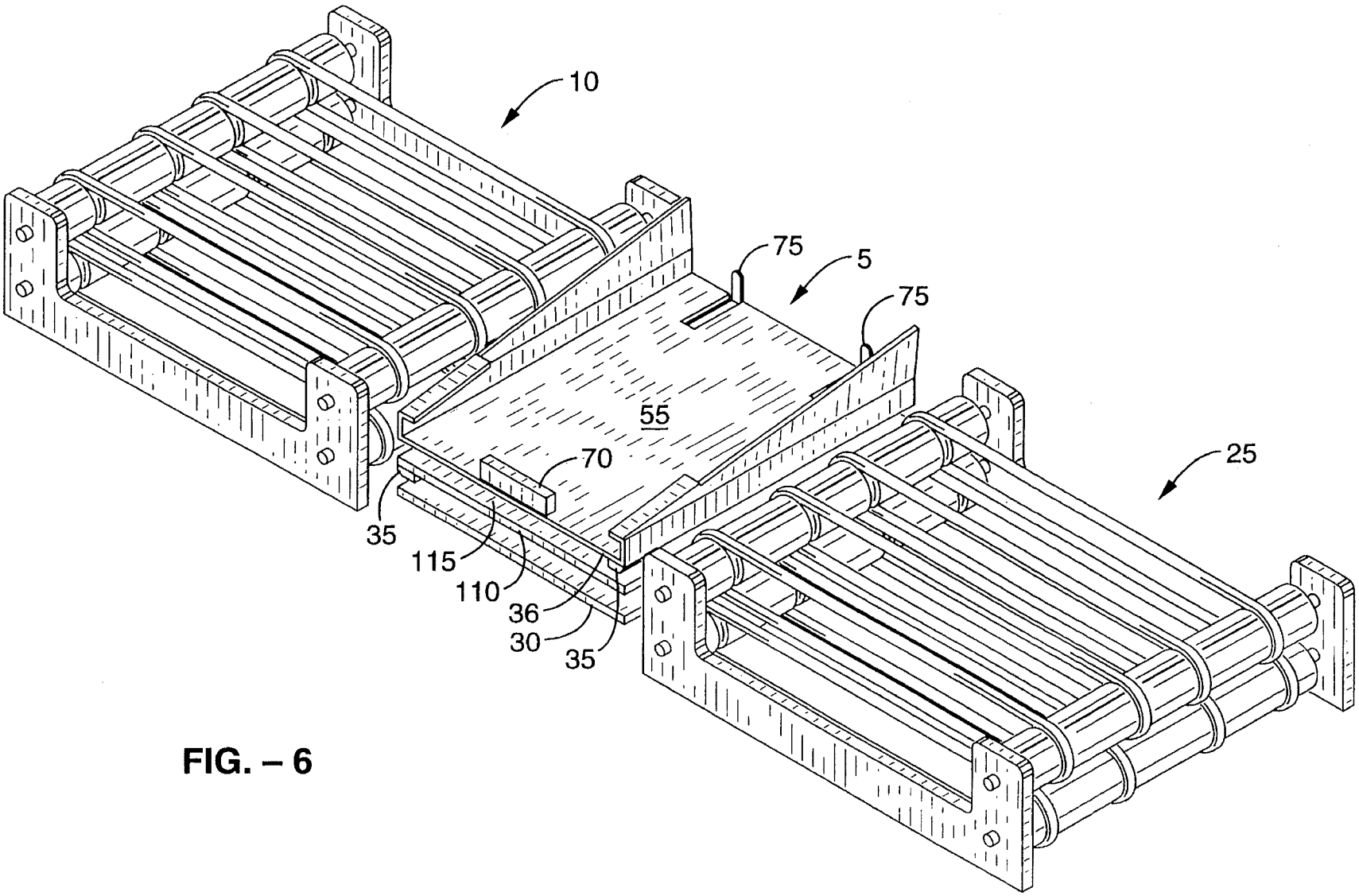
FIG. 6 is a perspective view of the collating means and two inputting means of the subject invention.

FIG. 6 delineates in more detail the orientation of the above recited inputting means when two inputting means 10 and 25 are included. The embodiment illustrate in FIG. 6 depicts an intermediate collator tray 110 with a page accepting space 115 immediate above. Just as with the first tray 30, an equivalent page funneling system is present, including a flared bar, kicker arm slots, and page barrier (not shown). Pages sent into the collator by the third inputting means 25, shown as paired and cooperating belts, enter the provided space 115. All of the pages of a given document packet within the multiple levels of tray are ejected by the kicker arms 75. Clearly, additional collator trays for receiving other source page streams can be positioned below the lower most tray depicted in the subject figures, thus generating an elevationally or vertically displaced plurality of trays. Additional inputting means would be coupled to each added tray layer.

Figure 7:
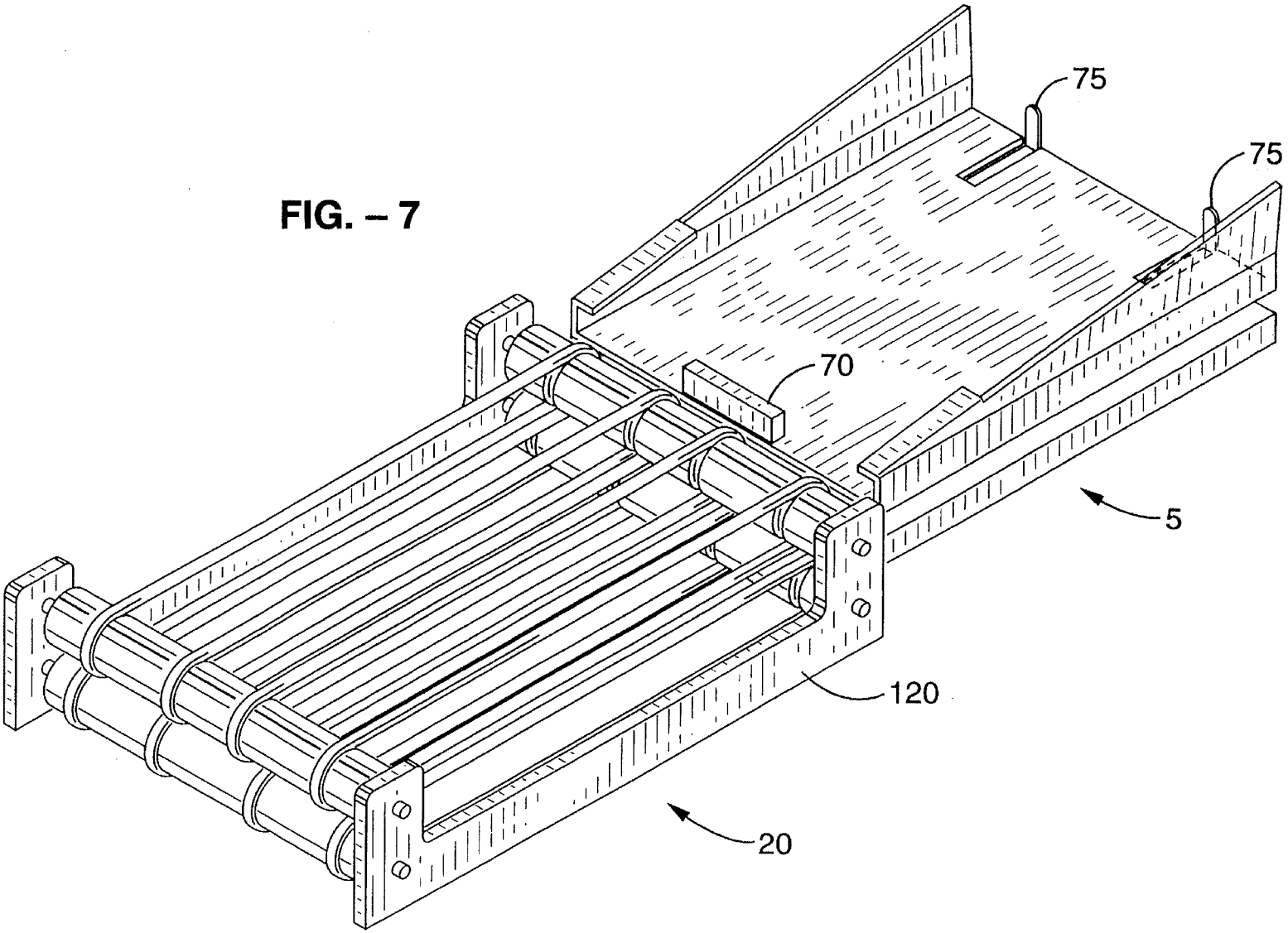
FIG. 7 is a perspective view of the subject collating means and associated outputting means.

FIG. 7 more clearly indicates the relationship between the transferring means 20 of the outputting means and the collator means 5. As described above, the transferring means is preferably a belt system 20, usually a set of cooperatively paired belts with upper and lower belts, for transferring the produced document packet from the subject collator 5 to a subsequent processing means X. A suitable frame 120 generally holds the belt system in proper a structural configuration.

Figure 8:
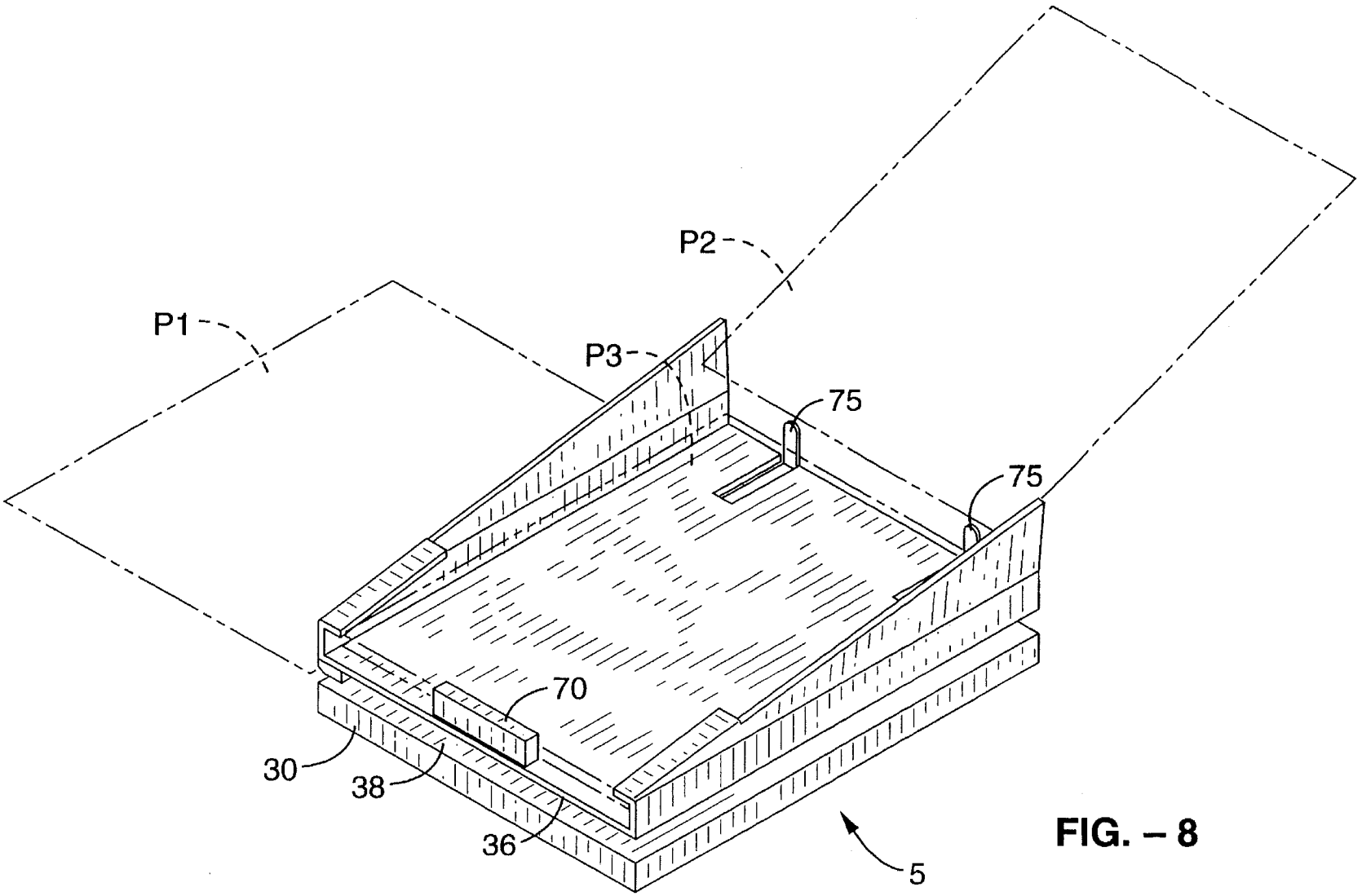
FIG. 8 is a perspective view of the subject invention illustrating the movement of incoming pages into the collating means.

FIG. 8 illustrates the transferal of incoming pages P into the collator means 5. Pages may enter the various tray layers at any time before the final ejection by the kicker arms 75. However, one preferred sequence for incoming document pages is to have all but the last detail page enter the upper tray 36 and then have the last detail page be transferred somewhat concurrently with the summary page into the lower tray 30. Specifically as seen in FIG. 8, one page P1 is entering the lower or first collating tray 30, another page P2 is entering the upper or second collating tray 36, and one or more pages P3 (two pages shown) are sitting within the second collating tray 36 between the gate 70 and the kicker arms 75.

Figure 9:
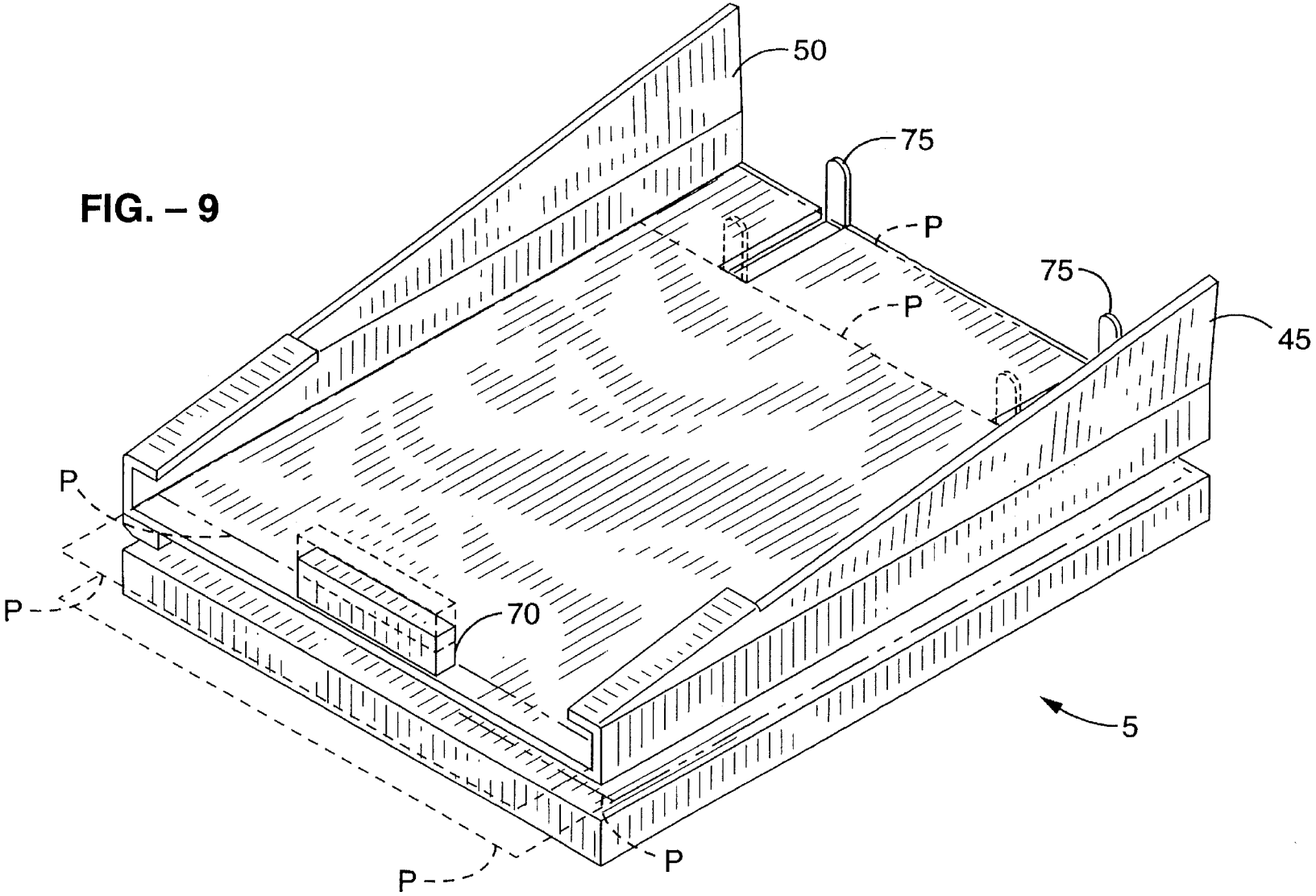
FIG. 9 is a perspective view of the subject invention illustrating the movement of outgoing pages from the collating means into the transferring means.

FIG. 9 portrays details of movement for the ejection of pages, forming the document packet, from the collator means 5 by the kicker arms 75. The dashed lines indicate the position of the activated kicker arms 75 and the ejected position of the transferring pages P. The ejected pages have the edges registered or aligned by the action of the kicker arms 75 and are carried by the transferring belt system 20 and onto the next process station. Only two levels of pages are shown in FIG. 9, however, additional levels of pages are ejected in an equivalent manner.

Preferably, detection means are included in the collating means 5 of the subject apparatus for establishing whether pages have been transferred into and from the collating means 5. The exact form and location of any detection means is not critical, however, a preferred type of detector is a light sensitive detector that signals when a light path is either blocked by the presence of a page or open when no page is present. Light beam detectors, pressure sensitive detectors, and equivalent detectors may be utilized by themselves or in combination in the subject invention. Various attachment points on the collating means 5 are suitable for securing the detection means and are primarily questions of engineering. For some preferred detector means locations the collating trays 30 and 36 and associated components may have apertures to accommodate the light beams (or like considerations) of the detection sensors.

The detection means 125, 130, 135, and 140 shown in FIG. 2 are placed at typical sites around the collating means 5 and in fact may comprise not solely one physical member but two (signal sending, signal receiving, and the like) or more interrelated detection units appropriately positioned to function in the page detection process. More specifically, a first detection means 125 is provided that establishes whether delivery of the first document page into the collating means 5 has been performed. Further, a second detection means 130 is supplied that established whether delivery of the second document page into the collating means 5 has been performed. Plainly, additional page delivery detection means can be included if the collating means 5 contains more than two levels of trays. Additionally, a third detection means 135 is included that establishes whether the collating means 5 actually contains the first or second document pages (or additional pages from other incoming sources). Also, a fourth detection means 140 is furnished that establishes whether the document packet has exited the collating means 5 to a subsequent processing means.

Preferably, the subject system includes for overseeing and directing the production of the document packets by the collating apparatus a computer means. The computer means is any suitable data handling and manipulating device now known or later developed that incorporates and utilizes the information in a database. The appropriate database (as indicated below) supplies the computer means with information concerning how many first, second, and additional pages comprise any particular document packet. The computer means then functions to regulate the overall process to create the individual document packets.

Figure 10:
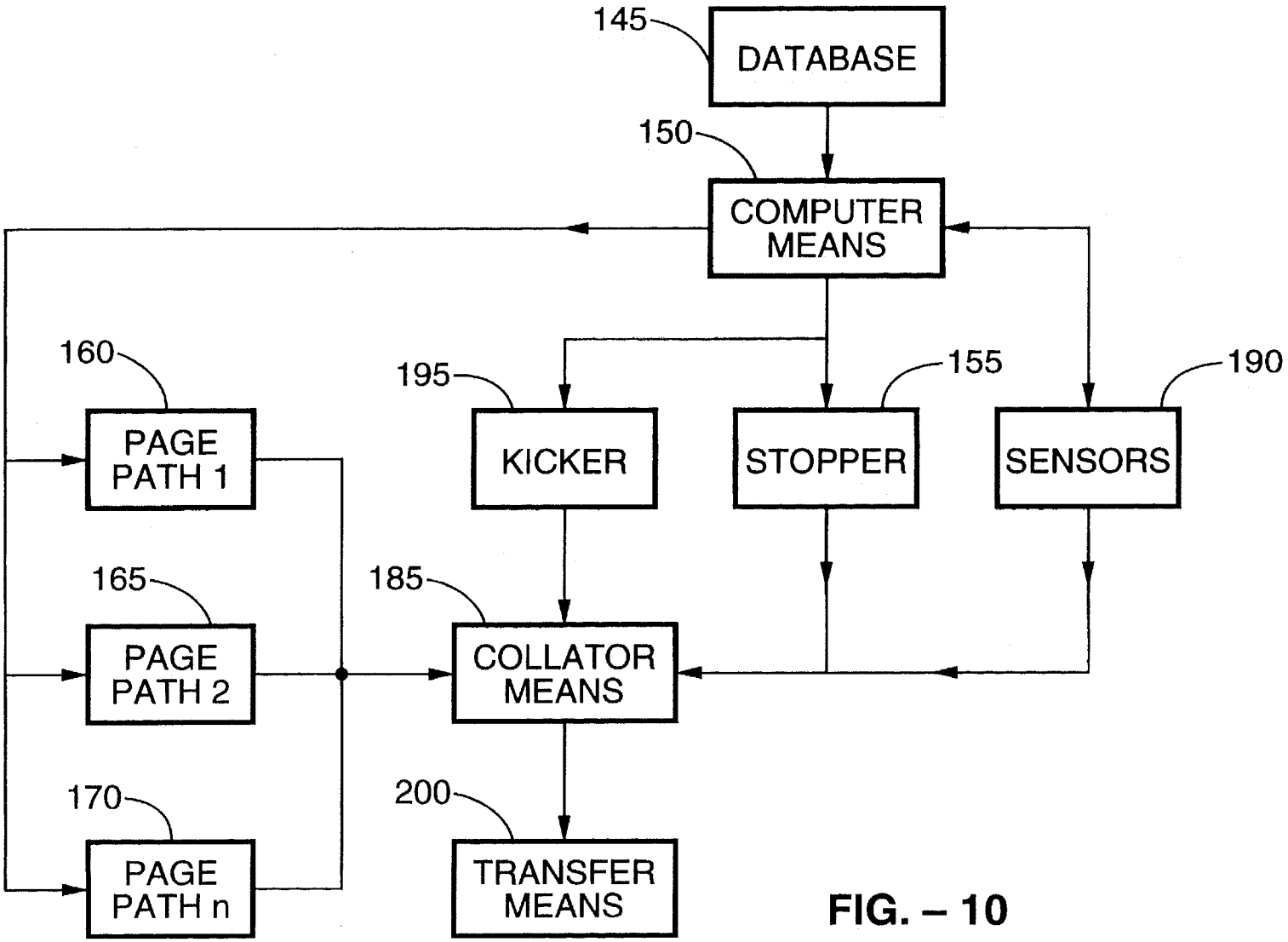
FIG. 10 is a flow diagram indicating a general control scheme and flow of pages in the subject invention.

In particular, FIG. 10 shows the generalized flow diagram that interconnects the appropriate data with the collating system. The database 145 holds the information that directs the number and type of pages destined to fill a particular document packet. For example, the database may contain names, addresses, financial information, current and past statement charges and the like for each customer that will be sent a billing document packet.

The database is utilized by the computer means 150 as instruction for assembling any particular document packet. Between the production of each document packet, the computer means 150 sets the page stopper 155 (or specifically retractable gate 70 in the figures) to block ejecting a still forming document packet from exiting the collating means 185.

By way of example only, if, according to the database and appropriate formatting by the computer means, a document packet is to contain one summary page and three detail pages, the computer means directs the page path 1 means 160 or first inputting means to deliver a single summary page (usually printed on only one side of the page) and page path 2 means 165 to deliver three detail pages (usually printed on both sides of the pages, if required). Should additional sources of incoming pages be desired or required, one or more page path n means 170 are similarly provided and controlled by the computer means 150. Generally, the summary page is in the first collator tray 30 in a face-down (printed side down) orientation. The initial face-down orientation of the summary page during formation of the face-down packet allows the created document packet to have the final pages oriented face-up.

The sensor means 190 for detecting page presence or absence includes any one, all four, or any combination thereof for the above described sensors (125, 130, 135, and 140). Once the selected sensors 190 have verified that a suitable state of page transfer has occurred (as determined by the database information), the computer means disengages the stopper 155 and activates the kicker 195 (specifically the kicker arms 75 in the figures). The kicker 195 then ejects the document packet into the transferring means 200 and from there to the subsequent process means.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A collating apparatus for producing a document packet from an incoming document page or pages, comprising:

a) a collating means having a plurality of vertically displaced collating trays with each said collating tray accepting a single document page or multiple document pages and b) outputting means coupled to said collating means for transferring said incoming page or pages from said collating means as the document packet to a subsequent processing means.

2. A collating apparatus according to claim 1, further comprising multi-directional inputting means for transferring into said collating means a plurality of streams of incoming document pages from at least two directions.

3. A collating apparatus according to claim 1, further comprising multi-directional inputting means for transferring into said collating means first and second streams of incoming document pages from two directions that are separated by approximately 90°.

4. A collating apparatus according to claim 1, further comprising detection means for establishing whether the document page or pages have been delivered into said collating means and whether the document packet has exited said collating means.

5. A collating apparatus according to claim 4, wherein said detection means further comprises means for establishing whether said collating means contains the document page or pages.

6. A collating apparatus for producing a document packet from an incoming document page or pages, comprising:

a) a collating means for producing the document packet, comprising:

a first collating tray for receiving at least a first document page;

a second collating tray secured to said first collating tray and having two opposing side walls and a bottom plate for receiving any second document page or pages; and b) outputting means for transferring the document packet created by said collating means to a subsequent processing means.

7. A collating means according to claim 6, wherein said outputting means comprises:

a) means for concurrently ejecting all document pages from said collating means to produce the document packet and b) means for receiving from said ejecting means and transferring to said subsequent processing means the document packet.

8. A collating apparatus for producing a document packet containing at least one document page from one or a plurality of incoming sources, comprising:

a) collating means for creating the document packet from incoming document pages;

b) first inputting means for feeding a first document page from a first incoming source into said collating means;

c) second inputting means for feeding a second document page from a second incoming source into said collating means; and d) outputting means for transferring the document packet created by said collating means to a subsequent processing means.

9. A collating apparatus according to claim 8, wherein said first imputing means comprises:

a) a first source containing said first document page for each document packet to be produced and b) means for transferring said first document page into said collating means.

10. A collating apparatus according to claim 8, wherein said second imputing means comprises:

a) a second source containing said second document page for each document packet to be produced and b) means for transferring said second document page into said collating means.

11. A collating apparatus according to claim 8, wherein said collating means comprises:

a) a first collating tray for receiving said first document page and b) a second collating tray secured above said first collating tray and having two opposing side walls and a bottom plate for receiving said second document page.

12. A collating apparatus according to claim 11, wherein said outputting means comprises:

a) means for concurrently ejecting all document pages from said collating means to produce the document packet and b) means for receiving from said ejecting means and transferring to said subsequent processing means the document packet.

13. A collating apparatus according to claim 8, wherein said collating means further comprises a first detection means for establishing whether delivery of said first document page into said collating means has been performed.

14. A collating apparatus according to claim 8, wherein said collating means further comprises a second detection means for establishing whether delivery of said second document page into said collating means has been performed.

15. A collating apparatus according to claim 8, wherein said collating means further comprises a third detection means for establishing whether said collating means contains said first or said second document pages.

16. A collating apparatus according to claim 8, wherein said collating means further comprises a fourth detection means for establishing whether said document packet has exited said collating means to a subsequent processing means.

17. A collating apparatus according to claim 8, wherein said second inputting means is displaced approximately 90° from said first inputting means.

18. A collating apparatus for producing a document packet containing at least one document page from one or a plurality of incoming sources, comprising:

a) collating means for creating the document packet from incoming document pages;

b) first inputting means for feeding a first document page from a first incoming source into said collating means;

c) second inputting means, displaced approximately 90° from said first inputting means, for feeding a second document page from a second incoming source into said collating means;

d) outputting means for transferring the document packet created by said collating means to a subsequent processing means; and e) detection means for establishing whether said first document page has been delivered into said collating means, whether said second document page has been delivered into said collating means, and whether said document packet has exited said collating means.

19. A collating apparatus according to claim 18, wherein said detection means further comprises means for establishing whether said collating means contains any of said document pages.

20. A collating apparatus according to claim 18, wherein said outputting means comprises:

a) means for concurrently ejecting all document pages from said collating means to produce the document packet and b) means for receiving from said ejecting means and transferring to said subsequent processing means the document packet.

21. A collating apparatus according to claim 20, wherein said concurrent ejecting means comprises a kicker that injects the document packet into the receiving and transferring means.

22. A collating apparatus according to claim 20, further comprising computer means for overseeing and directing said document packet production.

23. A collating system for producing a plurality of document packets with each document packet having at least one document page, comprising:

a) a database containing requisite information for forming each of the document packets;

b) computer means for accessing said database for requisite information to control producing each of the document packets;

c) a collating means having a plurality of vertically displaced collating trays with each said collating tray accepting a single document page or multiple document pages as directed by said computer means;

d) outputting means coupled to said collating means for transferring said incoming page or pages from said collating means as a single document packet to a subsequent processing means.

24. A collating system according to claim 23, further comprising multi-directional inputting means for transferring into said collating means a plurality of streams of incoming document pages from at least two directions.

25. A collating system according to claim 23, further comprising multi-directional inputting means for transferring into said collating means first and second streams of incoming document pages from two directions that are separated by approximately 90°.

26. A collating system according to claim 23, wherein said outputting means comprises:

a) means for concurrently ejecting all document pages from said collating means to produce the document packet and b) means for receiving from said ejecting means and transferring to said subsequent processing means the document packet.

27. A collating system according to claim 26, wherein said concurrent ejecting means comprises a kicker that injects the document packet into the receiving and transferring means.

28. A collating system for producing a plurality of document packets with each document packet having at least one page, comprising:

a) a database containing requisite information for forming each of the document packets;

b) computer means for accessing said database for requisite information to control producing each of the document packets;

c) collating means for creating the document packet as directed by said computer means;

d) first inputting means for feeding first document pages from a first source into said collating means as directed by said computer means;

e) second inputting means, displaced approximately 90° from said first inputting means, for feeding second document pages from a second source into said collating means as directed by said computer means; and f) outputting means for transferring each of the document packets created by said collating means to a subsequent processing means.

29. A collating system according to claim 28, wherein said outputting means comprises:

a) means for concurrently ejecting all document pages from said collating means to produce the document packet and b) means for receiving from said ejecting means and transferring to said subsequent processing means the document packet.

30. A collating system according to claim 29, wherein said concurrent ejecting means comprises a kicker that injects the document packet into the receiving and transferring means.

* * * * *